US005159758A

United States Patent [19]

MacDonald

[11] Patent Number: 5,159,758

[45] Date of Patent: Nov. 3, 1992

[54] CARPET CUTTING TOOL

[76] Inventor: Lea H. MacDonald, 327 McEwen Drive, Kingston, Ontario, Canada, K7M 3W2

[21] Appl. No.: 767,325

[22] Filed: Sep. 30, 1991

[30] Foreign Application Priority Data

Oct. 3, 1990 [CA] Canada ..... 2026790

[51] Int. Cl.[5] ..... B26B 29/00; B26B 29/06; B26B 29/02; B26B 21/52

[52] U.S. Cl. ..... 30/294; 30/293; 30/290; 30/289

[58] Field of Search ..... 30/280, 289, 292, 293, 30/294, 314, 290

[56] References Cited

U.S. PATENT DOCUMENTS

| | | | |
|---|---|---|---|
| 625,550 | 5/1899 | Geisendorff et al. . | |
| 2,601,414 | 6/1952 | Mittelstaedt . | |
| 3,363,314 | 1/1968 | O'Brien . | |
| 3,621,573 | 11/1971 | Summers | 30/29.4 |
| 3,724,071 | 4/1973 | Hurtubise | 30/294 |
| 3,728,791 | 4/1973 | Holmquist | 30/294 |
| 3,859,725 | 1/1975 | Anderson et al. | 30/294 |
| 3,934,341 | 1/1976 | Carlson . | |
| 4,064,627 | 12/1977 | Zanfini . | |
| 4,095,341 | 6/1978 | Crain . | |
| 4,646,439 | 3/1987 | Squires | 30/294 |
| 4,833,956 | 5/1989 | Roberts | 30/294 |
| 5,048,189 | 9/1991 | Aurness | 30/294 |
| 5,058,278 | 10/1991 | Colvin | 30/289 |
| 5,075,974 | 12/1991 | McIlhatten | 30/290 |

FOREIGN PATENT DOCUMENTS

| | | | |
|---|---|---|---|
| 821773 | 9/1969 | Canada . | |
| 907305 | 8/1972 | Canada . | |
| 1179112 | 12/1984 | Canada . | |
| 590099 | 6/1925 | France | 30/293 |
| 68020 | 5/1927 | Sweden | 30/293 |

OTHER PUBLICATIONS

Brochure by Roberts "Installation Tools", published by Roberts Consolidated Industries Inc.

Brochure by Crain Floor Covering Tools of "Top Cutter".

*Primary Examiner*—Douglas D. Watts

*Assistant Examiner*—Paul M. Heyrana, Sr.

*Attorney, Agent, or Firm*—Stevens, Davis, Miller & Mosher

[57] ABSTRACT

A carpet trimming tool is disclosed for trimming edges of two carpet sections to be placed into abutment and joined together by a thermo adhesive tape or the like. The device utilizes a base with a pair of transversely spaced, upwardly projecting blades cooperating with a downwardly directed clamping arrangement holding the two carpet sections in engagement one with each of the two blades. Since the two blades cut the respective carpet sections from the underside generally cutting only the base of the carpet, and due to the constant spacing between the two blades, the resulting joint is virtually entirely concealed as there is no damage to the tuft caused by the cutting.

13 Claims, 4 Drawing Sheets

CARPET CUTTING TOOL

FIELD OF THE INVENTION

The present invention relates to carpet cutting tools and in particular to a tool for trimming the edges of two carpet sheets which are to be connected together in a wall-to-wall carpeting or the like installation.

The trimming of such edges is routinely done by overlapping the edges of the two carpet pieces which had been turned over, and then simultaneously cutting through the backing of both layers of the carpeting to provide a straight cut. The two pieces of the carpeting are then secured together by any suitable means such as a thermoplastic adhesive tape.

One of the problems encountered in trimming the edges of two carpet pieces to be connected in such way is that the cutting develops a downward force which deforms the tuft of the carpet into the way of the penetrating blade. The result is a sheared-off tuft at the cut. Inevitably, it becomes visible when the two carpet parts are connected to each other. Virtually the same drawback is encountered when the cutting is conducted from top of the pile. When this is done with an ordinary knife, the shaving or shearing of the pile of the carpeting cannot be at least in the lower layer of the trimmed pair of carpet edges.

PRIOR ART

FIG. 1 shows a prior art method typical in the trade, of trimming the edges of two carpet sections which are to be joined with each other eventually in an abutting fashion. A suitable padding 10 is provided and placed underneath the overlapped carpet margins 11 and 12. It can be seen from the representation of FIG. 1 that the downward pressure exerted at blade 13 causes the tuft of the carpet to buckle sideways with the result that the pile 14 of both carpet margins 11 and 12 is forced in front of the moving blade. The result is in shearing and shaving the pile which gives rise to unsightly joints between the two carpets.

Attempts have been made to resolve this problem but so far they have been unsuccessful in that only a limited improvement has been obtained. One such arrangement is shown in FIG. 2. The two carpet edges 11, 12, are placed over each other and are treated with a tool which has a movable blade 15 which operates in association with downwardly directed flanges 16, 17 as shown. The presumption is that the pile of the carpet is outriggered and that this would bow the carpet as the blade glides through it. This second arrangement has still serious drawbacks. First, it is to be mentioned that the above representation of FIG. 2 is a very close reproduction of a diagram from promotional literature of a manufacturer of the tools of the type to which the invention pertains. The showing of the behaviour of the pile of the carpets does not necessarily correspond to the actual situation, particularly if one realizes that at least the lower carpet margin 11 is placed under the upper margin 12, not to mention the need for a relatively accurate overlap between the two carpets which is often impossible to achieve.

Another known device utilizes a pair of blades fixed to a base and directed downwardly. The blades are transversely spaced apart and are designed simultaneously to cut two straight edges. While this device presents a certain advantage in that it does not require the overlapping of the two edges trimmed, it still suffers from the drawback of cutting through the pile of both superimposed carpet sections which is disadvantageous as the eventual joint of the two carpets is still relatively conspicuous.

Thus, the need exists in the art to improve the operation of trimming the edges of two placing same in abutment and adhesively secure same to each other to conceal the seam.

SUMMARY OF THE INVENTION

It is an object of the invention to provide a device of trimming the edges of two carpets to be secured to each other in such a way that the two margins are cut simultaneously but only from below while virtually eliminating any contact between the cutting blade and the pile of the two carpet margins.

In general terms, the invention provides a carpet cutting tool comprising, in combination: a) a base having the shape of a normally generally horizontal plate having a leading end, a trailing end and two opposed sides, an upper surface and an undersurface; b) a pair of parallel, transversely spaced apart cutting blades secured to the base and projecting upwardly from said upper surface one near each of said sides, said blades having each a cutting edge at a leading margin thereof, said cutting edges being parallel with each other and being transversely spaced apart a distance generally corresponding to the spacing of said blades; c) a handle secured to the base and projecting upwardly therefrom, for selectively moving said base and thus the pair of blades in a longitudinal direction; and d) workpiece clamp including a pair of workpiece clamping members secured to said base and operatively associated one with each of said cutting blades to hold a margin of a respective carpet sheet in engagement with the respective cutting blade; whereby the margins of two carpet sheets placed freely side-by-side can be trimmed simultaneously, one by each of said blades.

BRIEF DESCRIPTION OF THE DRAWINGS

The invention will now be described by way of a preferred exemplary embodiment with reference to the accompanying drawings in which.

DETAILED DESCRIPTION OF PREFERRED EMBODIMENT

Figure 3:
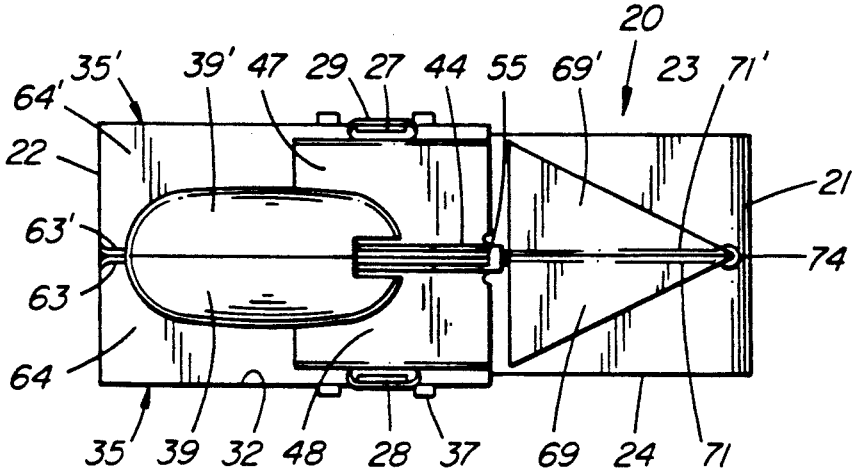
FIG. 3 is a top plan view of the device according to the present invention.

Turning now to FIGS. 3–6, and in particular to FIG. 3, reference numeral 20 denotes a base. The base has the shape of a rectangular plate having a leading end 21, a trailing end 22 and two opposed sides 23, 24. The top or upper surface is designated with reference numeral 25 and the lower surface, or undersurface, with reference numeral 26.

Figure 4:
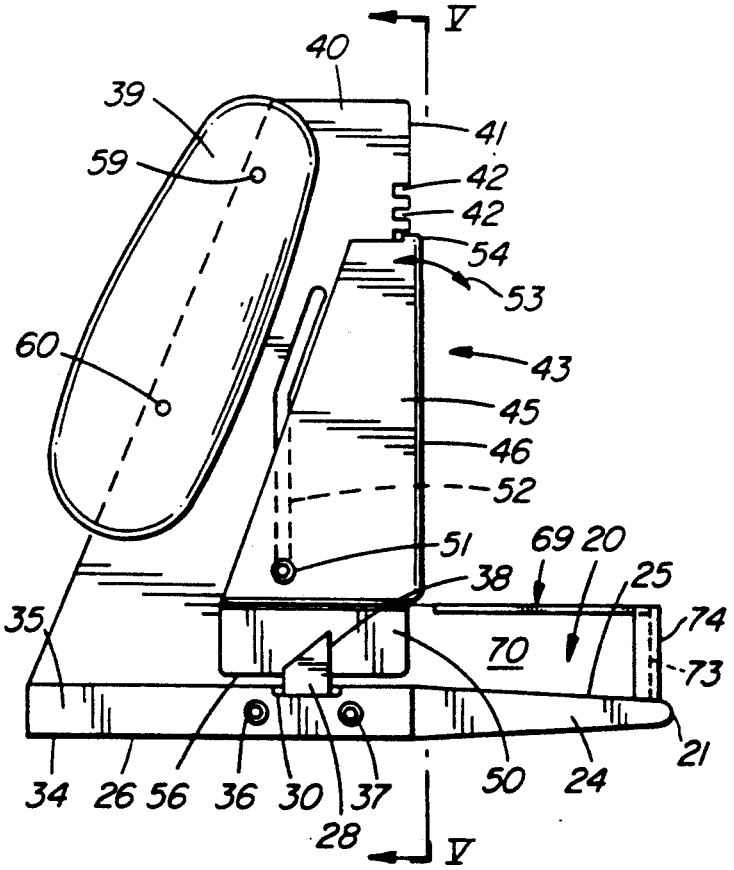
FIG. 4 is a side view thereof taken from one side of the device, the opposite side being identical.
Figure 5:
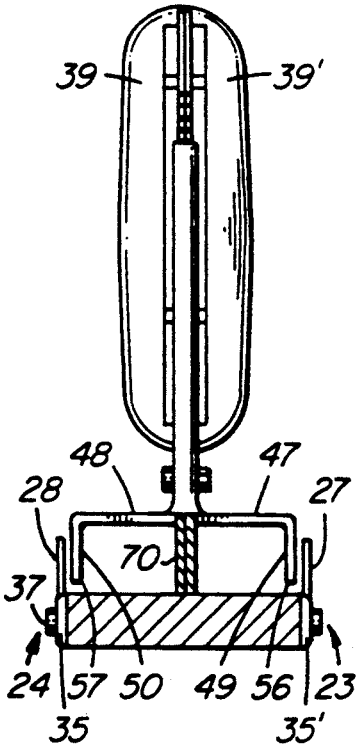
FIG. 5 is an end view thereof.
Figure 7:
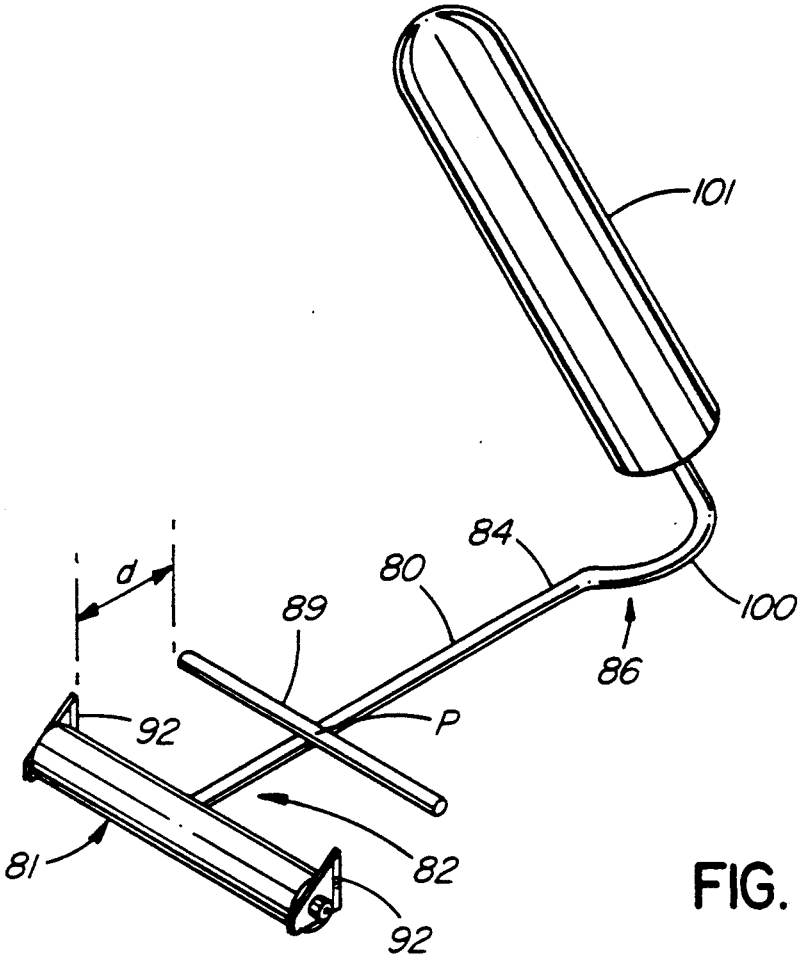
FIG. 7 is a simplified diagrammatic drawing of a second embodiment of the tool of the invention.
Figure 8:
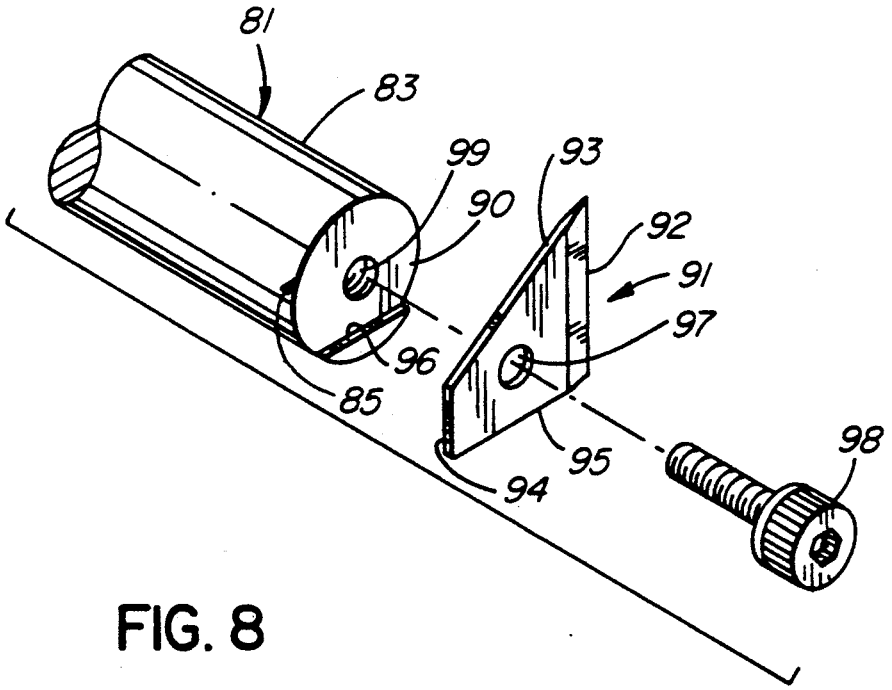
FIG. 8 is an enlarged detail of FIG. 7.
Figure 9:
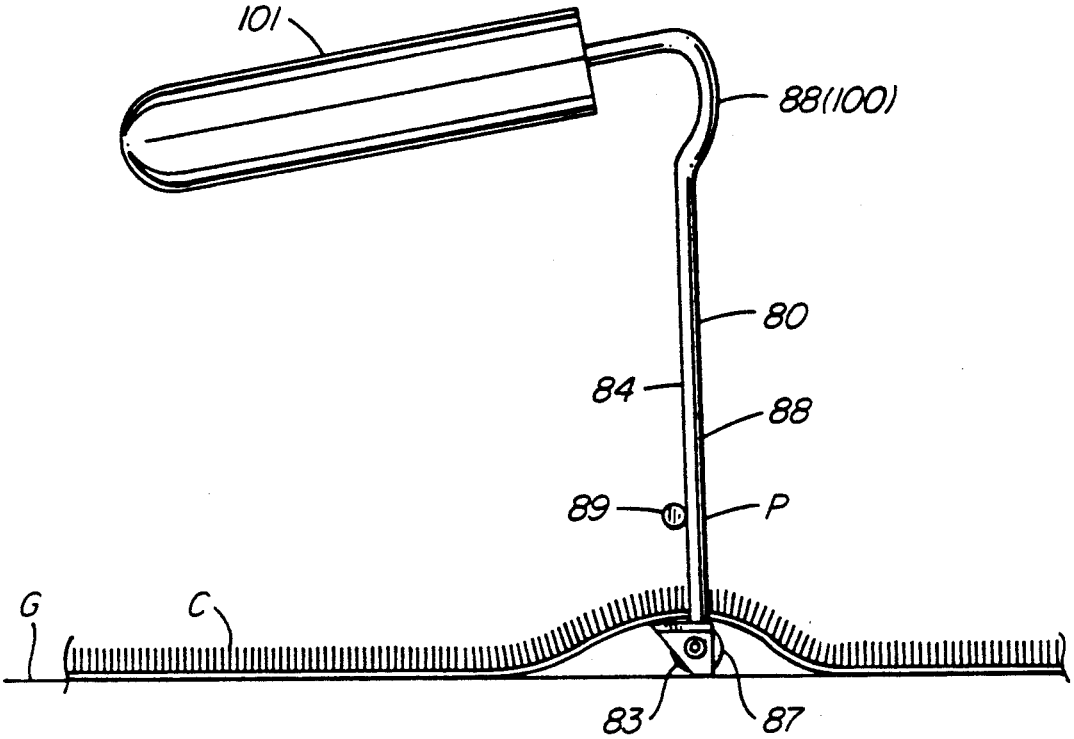
FIGS. 9 and 10 are simplified side views showing the operation of the tool.
Figure 10:
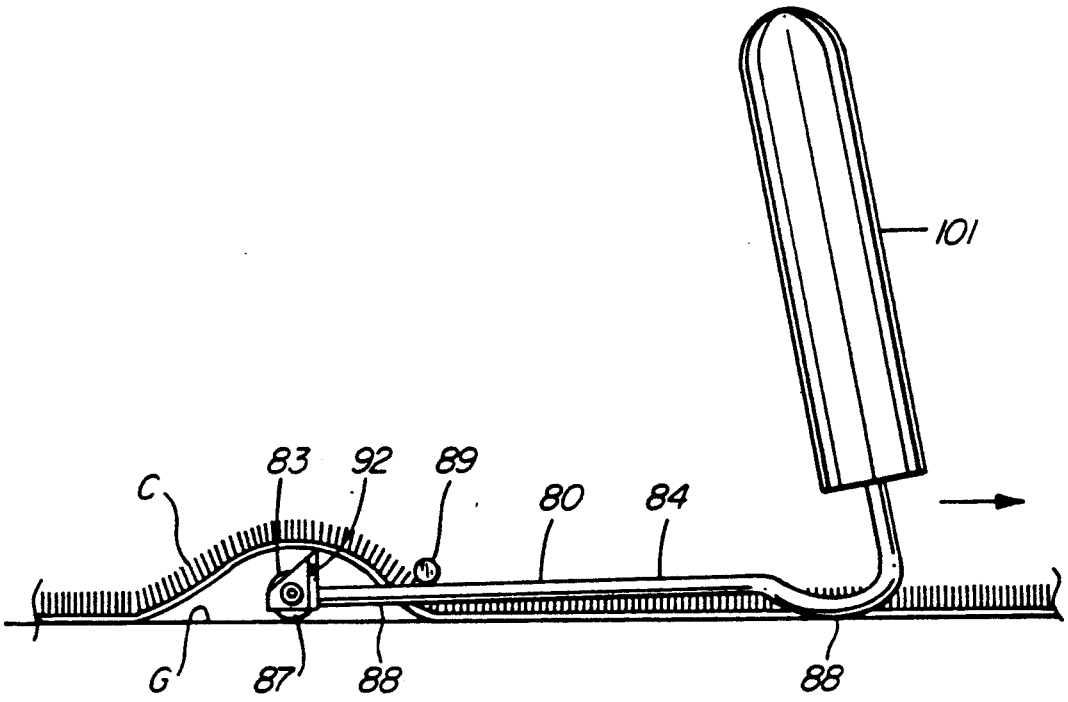

A first cutting blade 27 is secured to the base 20 at the side 23 and a second blade 28, transversely spaced from blade 27, is fixedly secured to the side 24 of the base 20. The way of securement of the blades 27, 28 to the base 20 is optional. It is preferred, however, that the height at which the blades 27, 28 project above the base be adjustable to secure that the blade is not too high as it might then cut through not only the base of the carpet but also through the pile. The cutting through the pile of the carpet portions is to be prevented. In the embodiment shown, the blade 27 projects upwardly from the base 20 through a slot 29, and the blade 28 projects through a slot 30. The slots 28 and 30 are each provided in the respective bend line 31, 32 which limits the upper margin of the cover provided on the sides 23, 24 by a stamping 33 (FIG. 6) which is made of a metal sheet. With reference particularly to FIG. 4, the lower margin 34 is formed by another bend line parallel with the line 32 to define a side portion 35 of a jacket enveloping the base 20 at the rear portion of the device as best seen in FIG. 3. The side portion 35 is pressed against the side 24 by a pair of bolts 36, 37, clamping the blade 28 with its leading cutting edge 38 in an upright position generally at right angles to the upper surface 25 of the base 20. FIG. 3 and FIG. 5 shows that the opposite side 23 is provided with an indentical arrangement which is therefore not described in greater detail. The pair of bolts on the side 23 and its associated portions correspond to those described.

A handle 39 is fixedly secured to a post 40 which, in the embodiment shown, has the shape of a flat panel having a leading edge 41 provided with a plurality of notches 42, equidistantly spaced one above the other along the leading edge 41.

The leading edge 41 of the post 40 is enveloped by a clamp member 43 which is of a U-shaped configuration in a top plan view, being comprised of a first side face 44, the opposed second side face 45, the two faces being adjoined with each other at a rounded front 46 forming a generally U-shaped envelope around the leading edge 41. The clamp member 43 has a pair of lower wings 47, 48, each provided with a downwardly dependent skirt portion 49, 50. The skirt portion 49 is disposed near the blade 27, the skirt portion 50 near blade 28. They are both disposed inwardly of the respective blades as best seen in FIG. 5.

The clamp member 43 includes a pivot pin 51 which is slidably received in a slot 52 provided in the post 40. The whole clamping member 43 is thus both pivotable about the point 51 (arrow 53 in FIG. 4), and slidable along the slot or guide groove 52. At the upper leading corner 54, the clamp member 43 is provided with a rearwardly extending tab 55 the size of which is designed to allow free movement of the tab 55 into and out of any of the notches 42. Thus, if the clamp member is pivoted clockwise of FIG. 4, the tab 55 (FIG. 3) is disengaged from the respective slot 42, allowing the sliding of the entire clamp member 43 along the slot 52 (and thus along the leading edge 41) to a predetermined position at which the clamp member 43 can be again re-engaged with the selected slot 42 by pivoting the clamp member 43 anticlockwise (FIG. 4), back into engagement, through the tab 55, with a selected notch 42. The described displacement of the clamp member 43 is one of many possible means of adjusting the spacing between the lower edges 56, 57 above the upper surface 25 of the base 20.

Figure 1:
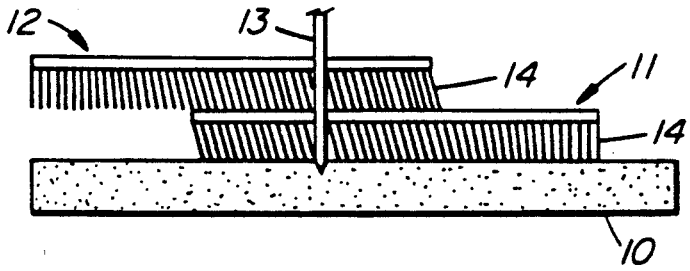
(PRIOR ART) FIG. 1
FIG. 1 is a diagrammatic representation of a presently employed manual method of trimming carpet edges before joining them together.
Figure 2:
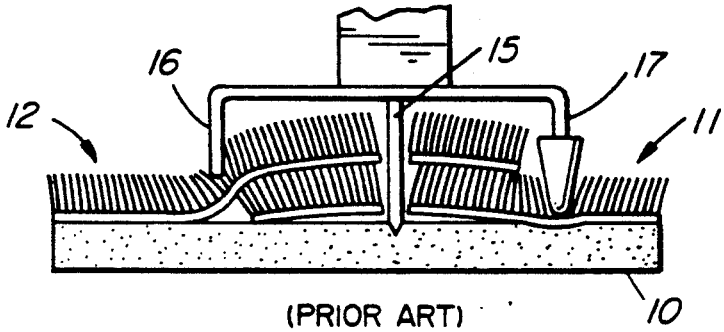
(PRIOR ART) FIG. 2
FIG. 2 is a representation similar to that of FIG. 1 but showing a known attempt to avoid the deficiencies mentioned above.
Figure 6:
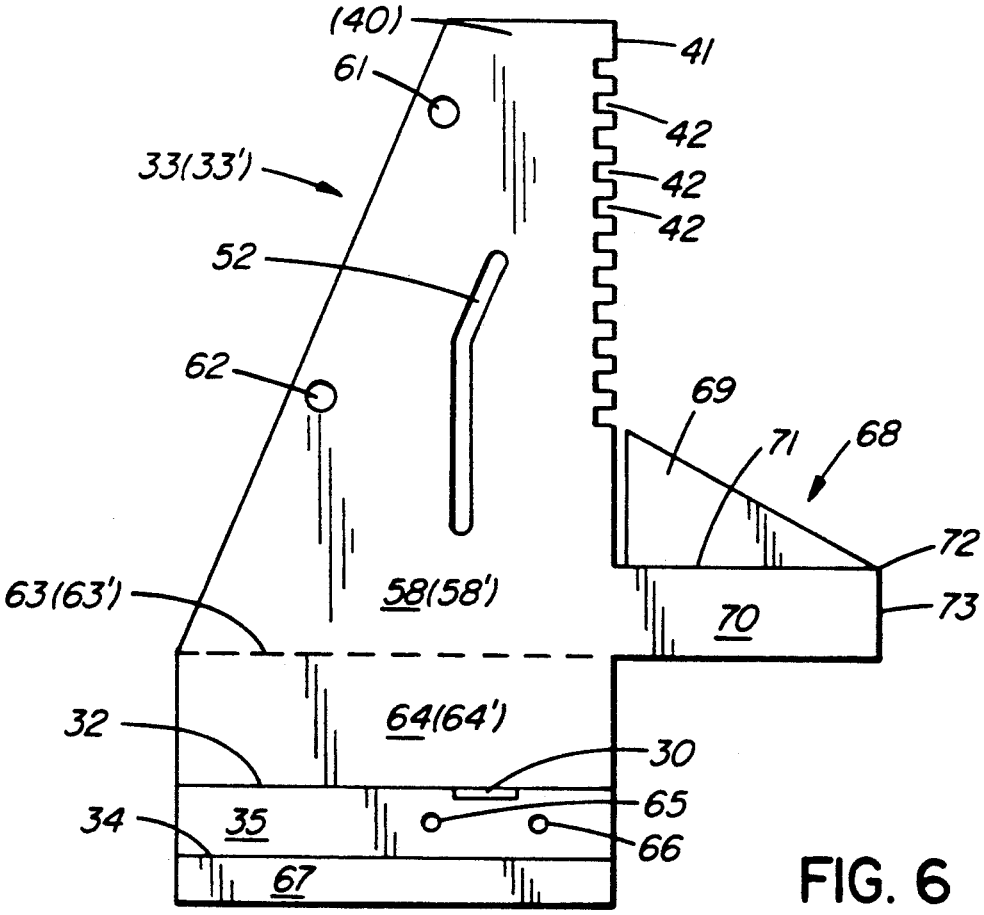
FIG. 6 is a diagrammatic view of one of two stampings used in the production of the supporting column.

Turning back to the post 40, it is made from two identical metal sheet stampings the shape of one of which is shown in FIG. 6 in an orientation similar to that of FIG. 4. The stamping is suitably bent to provide a fixed securement of the post 40 to the base 20. To this end, the stamping includes the generally trapezoidal upper portion 58 which coincides with the post 40 when the two stampings are held together with the handle 39 by way of two clamping screws 59, 60 passing through the handle portions 39, 39' and through passages 61, 62, in the stamping 33. There is a bend line 63 which coincides with the inner face of the post 40, see FIG. 3, to form an inner margin of a flat top section 64 covering a major part of the top surface of the base 20 as best seen in FIG. 3. The next panel of the stamping 33 is panel 35 which has already been referred to above. It is provided with a pair of passages 65, 66 for the bolts 36, as described. The bottom section 67 of the stamping 33 is bent under the base 20 to coincide with the lower surface 26 of the base.

A trapezoidal extension 68 projects from the leading edge 41 at a lower portion thereof. It is comprised of a triangular panel 69 and of a rectangular section 70 below the panel 69. The sections 69 and 70 are separated from each other by a bend line 71 which extends all the way to a tip portion 72. The tip portion 72 coincides with a leading edge 73 which, on assembly, is inserted in a rearwardly open slot provided in an upright stem 74 fixedly secured to the base 20 centrally of its leading end 21. The triangular panel 69 is bent about the bend 71 into a horizontal position, with the rectangular section 70 staying upright. The stem 74 has a substantially larger diameter than the combined thickness of the two stampings 33, 33', only the stamping 33 being visible in FIG. 6.

The overall symmetry of the two stampings is clearly indicated in FIG. 3 by utilizing primed reference numerals corresponding to some of the reference numerals referred to above. As an example, the top section 64 has its counterpart 64' in the opposed half of the device, the bend 63 has a counterpart in bend 63', the triangular panels 69, 69' are shown as form a delta shaped arrangement in FIG. 3, etc.

It should be emphasized that the described structure presents the description of a prototype of the device according to the invention and that many details of the structure could be modified and simplified, without departing from the scope of the present invention.

In operation, two carpet sheets which are to be trimmed for eventual adhesive joining of abutting edges, are placed on a flat surface, e.g. the floor, with their edges very closely to each other. The tool of the present invention is placed under the two sheets near one end of the desired trim such that the line of the gap between the two carpets is in general coincidence with the longitudinal axis. Such axis generally coincides with the location of the bends 63, 63', 79, 71' and also with the leading end stem 74. The front margin of the carpet is tucked under the delta wings 69, 69' (FIG. 3). The clamp member 43 is raised to its uppermost position and the carpets placed with their underside over the tips of the blades 27, 28. Eventually, the clamping member 43 is lowered such that its lower edges 56, 57 engage the top of the two carpets to hold same over the blades 27, 28. The clamping member 43 is then pivoted counterclockwise (53 in FIG. 4) to engage the tab 55 with the selected notch 42. As the column 40 is grasped, the palm of the operator engages the handle 39, while his fingers grasp the front 46 of the clamp member 43, urging the member 43 in anti-clock-wise direction. Thus, the tab 55 is pushed into the respective notch 42. The height of the clamping member is now adjusted. Vertical displacement of the clamp member 43 is now prevented. The two edges 56 and 57 now hold the carpet against the blades 27 and 28 but allow the sliding movement from the left to the right of the tool as seen in FIG. 3 or in FIG. 4. The sliding movement is generated by pushing against the handle 39, to move the tool to the right of FIG. 3 or FIG. 4. Such movement results in the blades 27 and 28 cutting the two carpets from underside, i.e. from the backing side of the carpets while the lower edges 57 and 56 merely glide over the pile of the two carpets holding the latter in engagement with the two blades. The height of the blades 27, 28, of course, had been adjusted to the particular thickness of the base of the carpets, to prevent undue penetration of the blade into the tuft of the carpet.

Turning now to the embodiment shown in FIGS. 7 through 10, a second embodiment is shown which presents a substantial simplification of the tool.

In this embodiment, the base member is formed by a normally generally horizontal T-shaped rod portion formed by a centrally disposed, longitudinal rod 80 and by a transverse beam 81. Both these elements are made of steel and are welded together at a trailing end portion 82 of the rod 80. The T-shaped structure shown defines a generally horizontal plane. The beam 81 and the rod 80 both have an upper surface portion 83, 84. Reference numeral 85 designates a trailing end portion of the beam 81 and numeral 86 is a leading end portion of the longitudinal rod 80. The transverse beam 80 is also marked with reference numeral 87 which designates the lower of bottom surface portion of the beam 81. The rod 80 is similarly marked with 88 to indicate the lower surface portion thereof. The lower surface portions of the base formed by the T-structure described are normally in contact with or face the ground G. While the entire lower surface portion of the beam 81 is in contact with the ground G, only the downwardly arched section at the leading end 86 of the rod 80 is in contact with the ground G, the remaining parts of the lower surface portion 88 being slightly spaced from and facing the ground G. For the sake of simplicity, however, the T-shaped structure may be considered as having the lower and the upper surface portions in two closely spaced apart and normally generally horizontal upper and lower planes or levels.

A retaining device formed by second transverse beam 89, also a steel rod, is welded to the upper surface portion 84 of the rod 80 at a point P close to the transverse beam 81 but between the leading and trailing end portions 82, 86 of the rod 80. The transverse beam 89 is parallel with the beam 81.

The opposite end faces of the beam 81 present each a generally flat clamping surface 90 (only one designated in the drawings-FIG. 8) which is complementary with the flat face of a cutting blade 91. The blade 91 is of a quadrangular configuration and includes a sharp cutting edge 92, a downwardly and rearwardly slanted top edge 93, a rear edge 94 and a lower, locking edge 95. The lower edge 95 is designated as a "locking edge" because it abuts, in an assembled state, with a shallow shoulder 96. The shoulder 96 is referred to as "shallow" as its width is about the same as the thickness of the blade 91. There is a hole 97 provided in the blade 91 for passage of a clamping bolt 98 which is completmentary with a threaded bore 99 in the end face of the beam 81.

Turning back to the leading end 86 of the longitudinal rod 80, it can be seen that it is provided with a downwardly turned end section 100 which then is turned upwardly and slightly forwards and receives a hand grip 101.

In operation, the blades such as blade 91 are fixedly secured to the beam 81. The two carpet panels which are to be trimmed are first placed in a close side-by-side fashion on a flat ground surface. The tool of the present invention is threaded with the rod 80 in the gap between the two carpets, with the clamping beam 89 being placed with each of its two transverse ends over one of the two carpets. The tool is then turned clockwise to bring same from the position of FIG. 9 to the position of FIG. 10. It can be seen that in this position the clamping rod 89 holds down each of the edge portions of the carpets to be trimmed while the cutting edge 92 is now in engagement with the base section of the carpet C. By pulling the handle 101 to the right of FIG. 10 the tool passes underneath the carpets trimming both edges of the underside in exactly the same fashion due to the fixed spacing between the two blades 91.

I found out that the tool is suitable for virtually all of the commercially used carpets if the spacing between the second beam 89 and the cutting edges 92 of the blades 91 is approximately 1⅛".

The blade 91 can be replaced with another blade or a blade portion if a deeper cut is required. The blade is preferably of the type described and claimed in my co-pending application Ser. No. 740,887 filed Aug. 6, 1991 which is incorporated herein by reference.

The length of the projection of the blade above the upper surface of the base is preferably smaller than the overall thickness of the carpet and is selected for cutting of just the base of the carpet. This provides a clear, uniform cut on the base of each of the two carpet sections which does not extend through the tuft and which therefore allows a much cleaner trim resulting in a virtually total concealment of the joint when the two trimmed sections are brought together and adhesively secured by a thermoplastic adhesive tape or the like, as is well known in the trade.

It will be appreciated by those skilled in the art that the present invention may be carried out by devices which may differ to a more or less substantial degree from the embodiment disclosed above without actually departing from the scope of the present invention. Accordingly, I wish to protect by letters patent which may issue on this application all such embodiments as properly fall within the scope of my contribution to the art.

I claim:

1. A carpet cutting tool comprising, in combination:

a) a base having the shape of a normally generally horizontal plate having a leading end, a trailing end and two opposed sides, an upper surface and an undersurface;

b) a pair of parallel, transversely spaced apart cutting blades, each blade having a normally lower end portion thereof secured to the base, a normally upper end portion defining a free tip portion of the blade projecting upwardly from said upper surface one near each of said sides, each blade having a cutting edge at a leading margin thereof, each cutting edge extending upward to the free tip portion of the respective blade a distance generally in excess of the thickness of a base layer of a carpet to be trimmed by the tool, but smaller than the overall thickness of the carpet, said cutting edges being parallel with each other and being transversely spaced apart a distance generally corresponding to the spacing of said blades;

c) a handle secured to the base and projecting upwardly therefrom, for selectively moving said base and thus the pair of blades in a longitudinal direction; and d) workpiece clamp including a pair of workpiece clamping members secured to said base and operatively associated one with each of said cutting blades to hold a margin of a respective carpet sheet in engagement with the respective cutting blade;

whereby the margins of two carpet sheets placed freely side-by-side can be trimmed simultaneously, one by each of said blades by cutting through the entire thickness of the base layers of the respective carpets but not through the entire pile thereof.

2. A carpet cutting tool as claimed in claim 1, wherein the handle is generally integral with a centrally disposed support column fixedly secured to the base and projecting upwardly from said upper surface thereof.

3. As claimed in claim 2, wherein said workpiece clamp means includes securement means for securing the clamp means to the column at a selected point of said column for a selective adjustment of the spacing between the clamping members and the upper surface of said base, said clamping members comprising two carpet engaging portions, one near each of the cutting blades.

4. A tool as claimed in claim 2, wherein said cutting edges are disposed at generally right angles to said longitudinal direction and terminate each at a point remote from said upper surface, in a sharp tip of the respective blade.

5. A tool as claimed in claim 3, wherein the two carpet engaging portions are equidistantly transversely spaced from said column a distance which is smaller than that of the corresponding transverse spacing of the blades from the column, whereby each carpet engaging portion is adapted to clamp a respective carpet margin at a point between the respective blade and the column.

6. A tool as claimed in claim 5, wherein said engaging portions are lower edges of downwardly dependent clamping blades, said lower edges facing said upper surface of the base.

7. A carpet cutting tool comprising, in combination:

a) a base member having a leading portion, a trailing portion and two opposite side portions, a normally generally horizontal top surface portion and a normally generally horizontal bottom surface portion;

b) a pair of parallel, transversely spaced apart cutting blades fixedly secured one to each of said side portions of the base member, said blades having cutting edges provided at leading edge portions of the blades, said cutting edges projecting upwardly above said top surface portion, said cutting edges being parallel with each other and being transversely spaced apart;

c) a handle fixedly secured to the base and projecting upwardly above the level of said top surface portion for selectively moving said base and thus the pair of blades in a longitudinal direction; and d) workpiece retaining device operatively associated with said cutting blades to maintain a margin of a respective carpet sheet in engagement with the cutting edges of said cutting blades, whereby the margins of two carpet sheets placed on a flat surface in a non-overlaping, side-by-side fashion, can be trimmed simultaneously, one by each of said blades as the tool is moved along a gap between the margins.

8. A tool as claimed in claim 7, wherein the base member is a normally generally horizontal T-shaped rod portion defining closely spaced apart levels generally coincident with said top and bottom surface portions, said T-shaped rod portion being formed by a centrally disposed longitudinal rod having a leading end portion and a trailing end portion, and a transverse beam fixedly secured to the trailing end portion of the longitudinal rod, said side portions being end faces of said transverse beam.

9. The tool of claim 8, wherein said workpiece retaining device is a second transverse beam fixedly secured to said longitudinal rod at a point between the transverse beam and said leading end portion of the longitudinal rod.

10. The tool of claim 9, wherein the distance between said second transverse beam and the cutting edges of said blades, as measured in a direction parallel with said longitudinal rod, is about $1\frac{1}{8}''$.

11. The tool of claim 9, wherein each said end face of the transverse beam defines a generally flat clamping surface for a cutting blade, a normally generally horizontal, straight, shallow shoulder forming a limit of the clamping surface, and a transverse threaded bore generally parallel with the axis of the transverse beam; the respective blade being clamped to the clamping surface by a clamping bolt threaded in said bore, said blade having a locking edge disposed at an angle to the cutting edge of the blade and engaging said shoulder.

12. A carpet cutting tool comprising, in combination:

a) a base having the shape of a normally generally horizontal plate having a leading end, a trailing end and two opposed sides, an upper surface and an undersurface;

b) a pair of parallel, transversely spaced apart cutting blades secured to the base and projecting upwardly from said upper surface one near each of said sides, said blades having each a cutting edge at a leading margin thereof, said cutting edges being parallel with each other and being transversely spaced apart a distance generally corresponding to the spacing of said blades;

c) a handle secured to the base and projecting upwardly therefrom, for selectively moving said base and thus the pair of blades in a longitudinal direction;

d) workpiece clamp including a pair of workpiece clamping members secured to said base and operatively associated one with each of said cutting blades to hold a margin of a respective carpet sheet in engagement with the respective cutting blade;

e) the handle being generally integral with a centrally disposed support column fixedly secured to the base and projecting from said upper surface thereof;

f) the column being a flat web generally at right angles to said upper surface and parallel with said cutting blades;

g) said flat web having a leading edge facing in the same general direction as the cutting edges, and two generally planar side faces each side face being turned to one of the side portions;

h) said clamp means including a support plate integral with said clamping blades, generally coincident with and pivotally secured to said flat web for pivoting relative to the flat web about a pivot having transverse pivot axis;

i) pivot shift means adapted to allow selective displacement of said pivot axis along said column, in a direction generally perpendicular to said upper surface;

j) locking means at said leading edge, including stop means and a plurality of stop receiving means disposed in a row extending generally at right angles to the upper surface of the upper surface, said stop means being provided in one of said flat web and said clamp means, said row being provided in the other one of said flat web and said clamp means; said locking means being adapted to engage and to disengage the stop receiving means by pivoting the clamp means relative to the flat web about said pivot axis, whereby the margins of two carpet sheets placed freely side-by-side can be trimmed simultaneously, one by each of said blades.

13. A tool as claimed in claim 12, wherein the locking means is so arranged that the grasping of the flat web and of the support plate urges the stop means into the respective stop receiving means.

* * * * *